United States Patent [19]

Klebold et al.

[11] Patent Number: 4,765,209

[45] Date of Patent: Aug. 23, 1988

[54] WRENCHES

[76] Inventors: Buddy Klebold, 1208 Oakhurst; Joe C. Howard, Jr., 1012 Jones, both of Clovis, N. Mex. 88101

[21] Appl. No.: 905,496

[22] Filed: Sep. 10, 1986

[51] Int. Cl.[4] ..... B25B 17/00

[52] U.S. Cl. ..... 81/57.17; 81/57.26; 81/57.27; 81/57.43; 81/64

[58] Field of Search ..... 81/57.17, 57.26, 57.43, 81/52, 64, 3.4, 3.43, 57.27, 177.6, 492

[56] References Cited

U.S. PATENT DOCUMENTS 2,357,595 9/1944 McPherson ..... 81/57.43
3,138,938 6/1964 Frizzell ..... 81/177.6

FOREIGN PATENT DOCUMENTS 3309803 9/1984 Fed. Rep. of Germany ..... 81/60

*Primary Examiner*—Frederick R. Schmidt
*Assistant Examiner*—Maurina Rachuba
*Attorney, Agent, or Firm*—Crutsinger & Booth

[57] ABSTRACT

Improved hand tools for installing or removing cap screws, bolts, nuts and the like from locations of difficult access. In one embodiment, the tool is fitted with a continuous elastomeric member that engages the work item and holds it on the tool while imparting rotation to it, thereby to install or remove the item. Disclosed additionally is a novel device featuring a handle part and a head part that permit installation or removal of the work item using one hand only. The head part is connected to the handle part by a section that permits double hinge-like movement between the parts, thereby imparting a high degree of adjustability for access to areas not directly accessible.

15 Claims, 3 Drawing Sheets

WRENCHES

BACKGROUND OF THE INVENTION

This invention relates to improved tools and more particularly to those adapted for removing and/or installing items from areas of difficult access.

At present, the general method for starting the threads on a nut, bolt, cap screw or other threaded fastener is manual, i.e., by the use of the fingers when the work area is readily accessible and not within a hostile environment, e.g., excessively hot or coated with an unfriendly substance such as a corrosive. However, there are instances in which the work area is either: (1) not easily accessible, or (2) in a hostile environment. In such instances, there has been a continuing need for improved tools for easily installing and/or removing workpieces such as threaded fasteners.

Various proposals have heretofore been made for solving the foregoing problems, illustrative of which are those set forth in U.S. Pat. Nos. 1,745,560 granted to Seilheimer on Feb. 4, 1930, 3,283,621 granted to Faso on Nov. 18, 1966, 3,288,002 granted to Mankovitz on Nov. 29, 1966, and 4,436,003 granted to Cox on Mar. 13, 1984. However, while the proposals of these patents were directed toward solving the problems, there yet remained the need for wrenches that were simple, inexpensive, versatile and that could be easily operated with one hand.

BRIEF SUMMARY OF THE INVENTION

The improved wrenches according to this invention provide an inexpensive and simple solution to these problems by including a continuous elastomeric O-ring like drive member to conduct rotational movement between the handle part and the drive head. In one embodiment there is included an intervening portion that is susceptible of hinge-like movement that can be employed to provide a broad range of relative positions between the head and handle parts, thus making it possible conveniently to access otherwise difficult-to-access work locations and positions such as, for example, where the head of a bolt lies at a variety of angles to the axis of accessibility; and in one embodiment, provision is made for directly driving the workpiece without the intervention of a socket or the like.

OBJECTS AND FEATURES

It is one general object of this invention to improve versatile hand tools.

It is another object of this invention to facilitate manufacture of versatile tools by simplifying their manufacture and reducing cost.

It is another object of this invention to provide an improved means of holding a work item such as a threaded fastener within a rotation-imparting member while positioning it in a difficult-to-access position.

It is another object of this invention to facilitate installing or removing the work item by operation with one hand only.

Accordingly, in accordance with one feature of the invention, a semi-pointed projection is provided near one end of a wrench handle, and a resilient belt-like member is provided to engage a workpiece temporarily placed upon the projection, thereby permitting the workpiece to be rotated upon the projection by linear movement of the belt-like member, thus simplifying construction and increasing versatility.

In accordance with another feature of the invention, a resilient O-ring-like member is positioned within or upon the head portion of a wrench that contacts a workpiece directly, thereby resiliently engaging the workpiece and maintaining contact between it and the workpiece, thus providing a simple and dependable way of holding certain types of workpieces upon the head of a wrench directly and without the necessity of an intervening member.

In accordance with still a further feature of the invention, according to another embodiment, the two principal ends of the wrench handle are joined by a double-hinged section permitting angular movement therebetween while retaining an operative connection through a resilient belt-like member, thereby providing an enhanced capability for accessing areas that are otherwise difficult to access.

In accordance with still another feature of the invention, a novel non-metallic snap-on member is adapted for being snapped onto a hub-like projection positioned on the head portion of the wrench, thus providing for quick and easy adaptation for differing sizes and shapes of workpieces.

In accordance with yet another feature of the invention, the snap-on member is fitted with an annular groove extending about the entire periphery thereof, thus providing a surface for operative engagement with the O-ring-like member.

In accordance with still a further feature of the invention, the structure of the tool, in one embodiment, is adapted for the optional provision of a light for illuminating the workpiece and/or work area and for the internal conduction thereto of power from an attendant battery pack or external source.

These and other objects and features of the invention will be apparent from the following detailed description of preferred embodiments, with reference to the drawing in which:

DESCRIPTION OF A PREFERRED EMBODIMENT

Figure 1:
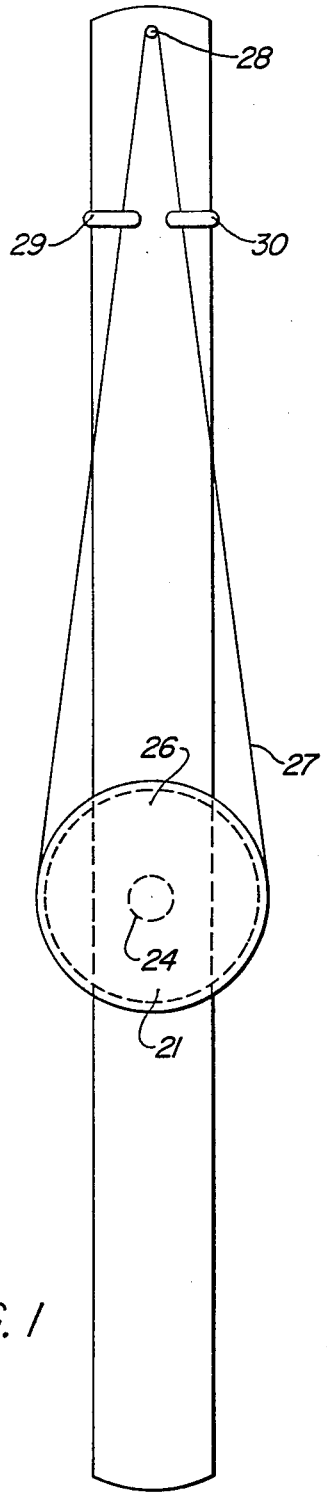
FIG. 1 is a top plan view of a wrench-like tool.
Figure 2:
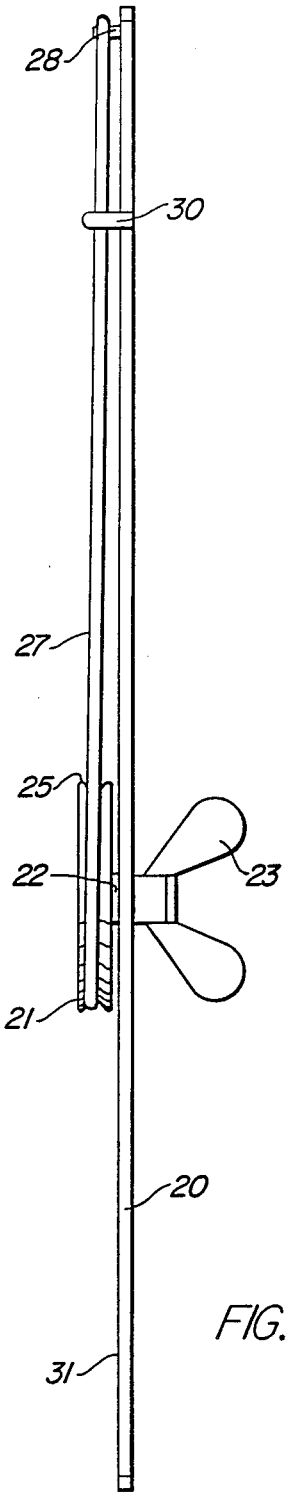
FIG. 2 is a side elevation view of the wrench-like tool of FIG. 1.

Now turning to the drawing, and more particularly FIGS. 1 and 2 thereof, it will be observed that there is therein depicted a wrench having a main body 20 which serves both as an extension portion and as a handle. This main body may be made of metal or one of the non-metallic materials well known to those skilled in the art. Mounted on the main body 20 is driving wheel, or pulley, 21 which is mounted on a hub-like cylindrical extension 22 of a wing-nut-shaped member 23. The wing-nut-shaped-member 23 may be a conventional wing nut that is affixed to extension 22 so that the wing nut does not turn with respect to extension 22 when rotational torque is imparted thereto. Extension 22 projects through a circular aperture 24 centrally disposed in main body 20. The diameter of the aperture 24 is only slightly larger than that of cylindrical extension 22 so that while rotational movement of the pulley 21 occurs when member 23 is turned, there is no wobble.

Within the edge 25 of pulley 21 is a portion 26 of reduced diameter, thus forming a circular groove 26 as shown. This circular groove 26 provides a region in which the lower portion of elastomeric O-ring-like member 27 is retained while motion is imparted to it by pulley 21.

At the upper end of main body 20, there is provided an extending projection 28 which preferably curves upwardly slightly as shown in FIG. 2. Moreover, projection 28 may optionally taper in diameter to a dull point so that its semi-pointed end will engage threads on the inner surfaces of nuts or similar workpieces when such are utilized with the tool.

As will be evident, the upward curvature prevents the O-ring-like member 27 from slipping off of projection 28 when the tool is not being used, thus making the tool easier to store.

Also, to keep the O-ring-like member 27 in place when either being used or stored, two hook-like retaining members 29 and 30 are provided. These extend at right angles to the main surface 31 of body 20 for a distance sufficient to permit clearance of O-ring-like member 27, after which they turn at right angles toward each other as shown in FIG. 1.

Figure 3:
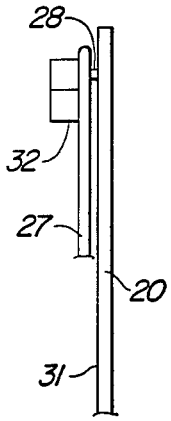
FIG. 3 is a detail view illustrating the positioning of a nut on the tool of FIGS. 1 and 2.

Now turning to FIG. 3, the upper portion of the tool of FIGS. 1 and 2 is shown to include a conventional threaded nut 32 disposed on projection 28. Positioning of the nut can be accomplished easily by slipping the O-ring-like member 27 off of projection 28, placing the nut on the projection so that the point of the projection extends into the nut (as shown). The O-ring-like member 27 is then stretched so that it is looped over the exterior of the nut and is then permitted to contract so as to engage the nut with a slight resilient retaining force.

Operation of the tool will now be evident to one skilled in the art. By turning (rotating) the wing-nut-like member 23, corresponding rotational movement is imparted to wheel 21 which in turn moves resilient O-ring-like member 27, thus imparting a corresponding rotational movement to the workpiece, e.g., nut 32.

Figure 4:
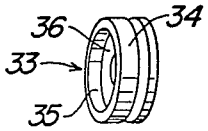
FIG. 4 is a perspective view of an attachment adapted for use with the tool of FIGS. 1 and 2.
Figure 5:
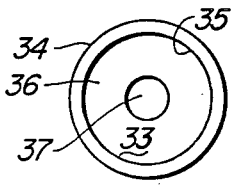
FIG. 5 is an end view of the attachment of FIG. 4.
Figure 6:
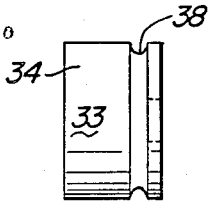
FIG. 6 is a side elevation view of the attachment of FIG. 5.

In some instances it may not be practicable to directly drive the workpiece with O-ring-like member 27. In such event, the tool may be advantageously employed with an auxiliary member such as that shown in FIGS. 4, 5 and 6; or it may be advantageously employed with the improved workpiece holding members disclosed in co-pending U.S. patent application Ser. No. 905,495, filed on even date herewith. The auxiliary member 33 may be made of any suitable metallic or non-metallic materials such as those that are well known to those skilled in the art. It comprises cylindrical main body portion 34 that extends inwardly a sufficient distance so that the inner surface 35 thereof can engage the exterior surface of a nut, bolt or the like sufficiently so as to hold it place with a friction fit. At the inner end of member 23 there is a partial closure wall 36 having in the center thereof, a circular aperture 37, the exact size of which is not critical so long as it is sufficiently large to permit projection 28 of the tool of FIGS. 5 and 6 to extend therethrough.

Auxiliary member 33 includes groove portion 38 (FIG. 6) which is provided for engagement with O-ring-like resilient driving band 27, thus permitting rotational drive of member 33 when member 33 is positioned on the tool in the location shown for nut 32 in FIG. 3; and member 33 is provided in a variety of sizes to friction fit with those workpieces for which it is intended to be used.

Figure 7:
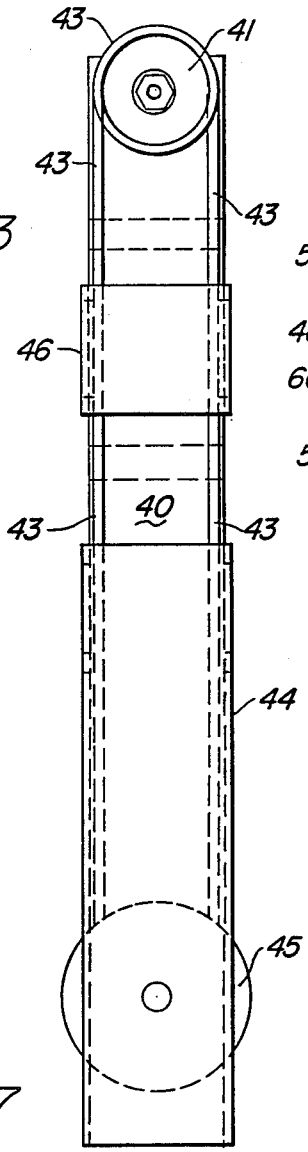
FIG. 7 is a top plan view of another wrench-like tool.
Figure 9:
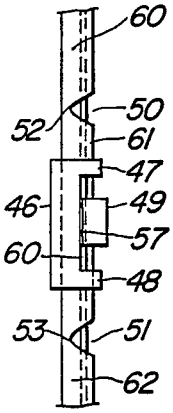
FIG. 9 is a partial side elevation view of the tool of FIGS. 7 and 8.
Figure 8:
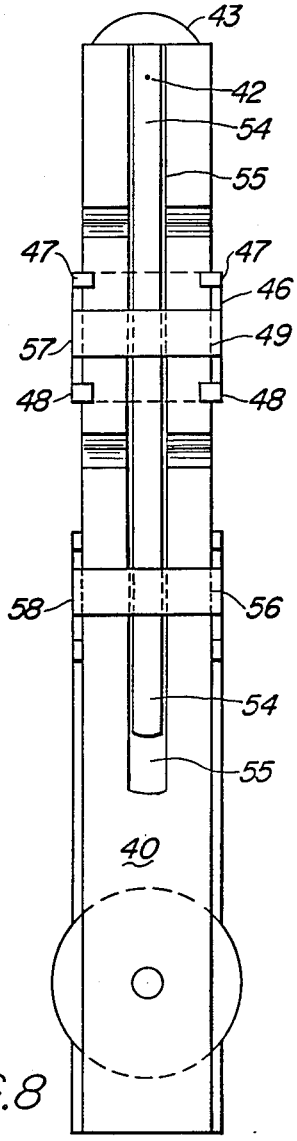
FIG. 8 is a bottom plan view of the tool of FIG. 7.

Now turning to FIGS. 7, 8 and 9, a more versatile embodiment is depicted. There, it will be observed, is shown a tool having an elongated main body 40 which is made of a suitable material such as polyethylene or the like. At the upper end of body 40 is positioned a wheel-like member 41 rotatably mounted on a hub 42 (FIG. 8). Engaging the periphery of member 41 is a O-ring-like member 43 which, as with the embodiment of FIGS. 1 and 2, rotates drive member 41 when the tool is being operated.

Protective cover member 44 is positioned over the lower part of the tool as shown in order to protect the operating wheel 45 and the lower part of the O-ring-like member 43 from accidental damage; and a similar protective cover member 46 is included to provide an upper guide for O-ring-like member 43 and a convenient means of providing lateral movement stops 47 and 48 (FIGS. 8 and 9). These lateral movement stops prevent lateral movement of sliding bar 49 from exceeding the desired range as is more particularly described hereinafter.

As is evident from an inspection of the drawing, sufficient clearance exists between the main body 40 and the protective covers 44 and 46 to permit free movement of O-ring-like member 43. This also permits installation of wire conductors (not shown) that can be installed between the covers and the main body so as to provide power to operate an optional light (not shown) that can be positioned on the head portion of the tool if desired. Power for such a light can be provided by a small battery pack positioned on the handle part of the wrench or from an external source.

Referring to FIG. 9, it will be observed that main body 40 is substantially reduced in thickness by semi v-shaped regions 50 and 51 at two locations, thus forming thin regions 52 and 53 which, due to their thinness and type of material, act as living hinges to permit substantial bending of the tool body at both such locations, and thus effectively dividing the tool into three sections: an upper section 60, an intermediate section 61, and a lower main section 62. A thin rectangular cross section ribbon-like strip 54 of readily bendable material (which may also be polyethylene or the like) is attached to the upper part of the tool by the hub 42 (FIG. 8) and is generally carried within a corresponding longitudinal recess 55. Sufficient clearance is provided between the ribbon 54 and the mating recess 55 to allow movement of the ribbon.

The material of ribbon-like strip 54 is not readily compressible or stretchable longitudinally so that it conducts force longitudinally therethrough. This permits positioning of the three sections 60, 61 and 62 with respect to each other as is described below.

Sliding bar 49 and a similar lower sliding bar 56 are provided to disengageably grip ribbon 54 and lock it in desired positions, thus resulting in the desired bending of the body at grooved thin regions 52 and 53. Since sliding bars 49 and 56 are independent of each other, the tool has the capability of assuming a wide variety of shapes.

Figure 13:
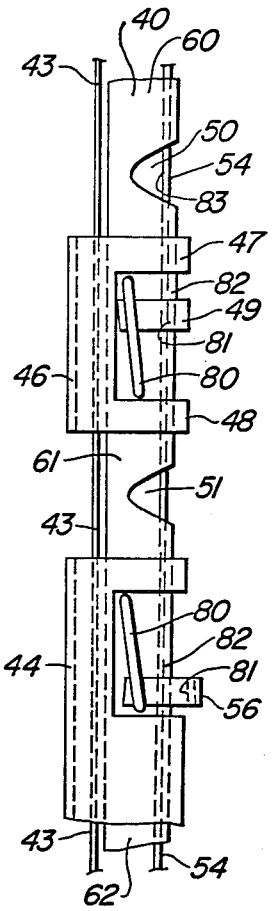
FIG. 13 is a partial side elevation view of the tool of FIGS. 7, 8 and 9.

Sliding bars 49 and 56 may be slideably joined to main body 40 by any of a variety of known techniques. However, the preferred way is by forming a thin groove 80 (such as that shown at 60 in FIG. 13) in the edges of the body and snapping the u-shaped bars 49 and 56 into place, with the extending parts 57 and 58 being held in place within the grooves. Since the grooves are at a slight angle to the axis of the main surface of longitudinal recess 55, lateral movement of the sliding bars changes the clearance between their under surfaces 81 and the upper engaging surfaces 82 of the ribbon 54. When the sliding bars are near one end of their permitted travel, this clearance is reduced to zero, and further travel of the sliding bar exerts pressure on the ribbon, thus locking it into place.

The mating surface 83 of longitudinal recess 55 may be roughened or serrated in order that pressure exerted upon ribbon 54 by sliding bars 49 and 56 more effectively locks ribbon 54 in place and temporarily prevents it from sliding. In addition, it is preferred that corresponding roughening or serration be provided in the mating surface (under surface) of ribbon 54 thereby further improving the locking characteristic of the ribbon.

Figure 10:
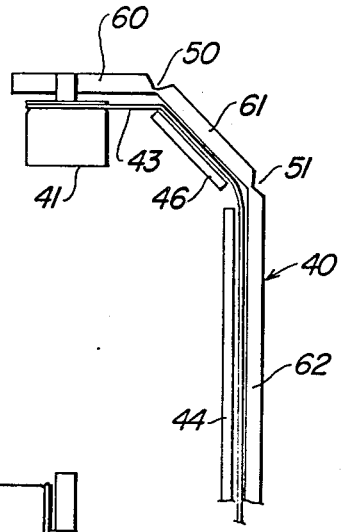
FIG. 10 is a side view depicting the tool of FIGS. 7–9 when in one illustrative condition.
Figure 11:
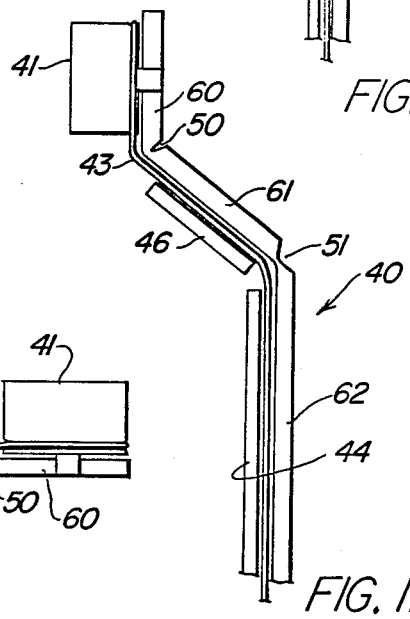
FIG. 11 is a side view depicting the tool of FIGS. 7–9 when in another illustrative condition.
Figure 12:
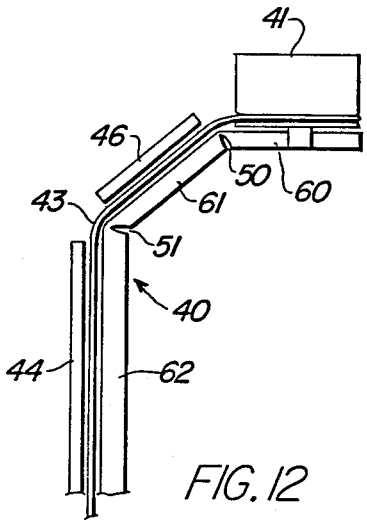
FIG. 12 is a side view depicting the tool of FIGS. 7–9 when in still another illustrative condition.

FIGS. 10, 11 and 12 symbolically depict the tool in three configurations to illustrate its extreme versatility. In FIG. 10, the intermediate portion of the tool is flexed to an approximate forty-five degree angle counterclockwise, and the upper part is flexed to approximately the same angle and the same direction, thus providing a ninety-degree counterclockwise angulation. In this position, the tool can operationally access a workpiece whose working head is 180 degrees displaced from that of the operator.

In FIG. 11, the intermediate portion is flexed to an approximately forty-five degree angle counter clockwise, and the upper part flexed to an approximately forty-five degree angle clockwise, thus creating an offset configuration. In this position, the tool can operationally access a workpiece whose working head is 90 degrees displaced from that of the operator and which is obscured from direct access by an intervening obstruction.

In FIG. 12, the intermediate portion of the tool is flexed to an approximate forty-five degree angle clockwise, and the upper part is flexed to approximately the same angle and in the same direction, thus providing a ninety-degree clockwise angulation. In this position, the tool can operationally access a workpiece whose working head is parallel axially with the operator but displaced laterally.

It will be evident from FIGS. 10, 11 and 12, that the tool can readily access workpieces in a variety of restricted areas and including situations in which the workpiece faces toward or away from the operator. Of course, it will also be evident to those skilled in the art that the tool could readily be set to an endless variety of other configurations, thus providing a continuously variable positioning of the head with respect to the body over a wide range of angulations.

In operation, both sliding bars 49 and 56 are slid to positions permitting free movement of ribbon 54. The upper portion 60 is then configured to the desired angle with respect to intermediate section 61, and upper sliding bar 49 is then slid to the locking position. Intermediate section 61 is then angulated to the desired angle with respect to the lower, or main body, section 62, and sliding bar 56 is then slid to the locking position to complete the temporary geometrical configuration of the tool. The tool may then be gripped with one hand only, and the operating pulley 45 can be operated by the fingers of the same hand that is holding the tool, thus permitting one-handed operation if desired.

It is to be understood that the tools herein disclosed are not intended to provide sufficient torque to loosen fully tightened devices such as bolts, nuts and the like, but is intended to remove them, once untorqued, or to install them in place short of final torqueing.

It will now be evident that there has been described herein, improved tools that provide a wide range of versatility in use and that permit access to a variety of otherwise difficult-to-access locations. The tools also permit ready access to workpieces positioned in a variety of angles with respect to the operator. It should also be evident that the improved tools are simple in design and easy and relatively inexpensive to manufacture thus contributing to their attractiveness and desirability.

Although the invention hereof has been described by way of example of preferred embodiments, it will be evident that other adaptations and modifications may be employed without departing from the spirit and scope thereof. For example, other locking arrangements could be employed for the positioning ribbon.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. An improved tool especially adapted for supporting and rotating a threaded workpiece to be installed or removed from locations of difficult accessibility, said tool comprising an elongated body having a rotatable member mounted to the body near one end thereof and a manually rotatable pulley near the other end thereof, and a continuous resilient elastomeric band connecting said member and pulley in operative relationship whereby when said pulley is turned, said member correspondingly is turned, said elongated body having, intermediate said member and said pulley, at least one thin localized transverse region disposing said elongated body into interconnected hinged sections and providing for hinged movement of said sections with respect to each other about an axis substantially perpendicular to the axis of the rotatable member, and control means for hingeably moving said sections with respect to each other and temporarily locking said sections to configure said elongated body in any of a plurality of positions.

2. An improved tool according to claim 1 in which said continuous resilient elastomeric band is an O-ring.

3. An improved tool according to claim 1 in which said rotatable member is disposed in one of said hinged sections and in which said pulley is disposed in another of said hinged sections.

4. An improved tool according to claim 3 in which said pulley is disposed in the hinged section most remote from said one of said hinged sections.

5. An improved tool according to claim 3 in which said continuous resilient elastomeric band is an O-ring.

6. An improved tool according to claim 1 wherein the control means includes a flexible ribbon affixed to one of said sections, said flexible ribbon extending longitudinally along the length of said tool across the thin localized transverse region and terminating at a predetermined location adjacent a second section.

7. An improved tool according to claim 6 wherein said means for suitably locking includes a transverse bar longitudinally slidable along said elongated body adjacent said ribbon, said bar engaging thin grooves in the sides of said elongated body, said grooves being at a slight angle to said body, so that longitudinal movement of said bar along said body causes said bar to releasably lock said ribbon to said body.

8. An improved tool according to claim 7 wherein the adjacent mating surfaces of the ribbon and the second section are adapted for fixed frictional engagement to each other as by one of roughening and serration of the mating surfaces.

9. An improved tool according to claim 6 further comprising a second thin localized transverse region intermediate said member and said pulley and spaced from said first thin localized transverse region so that said elongated body is disposed into three interconnected hinged sections and said ribbon extends across the third section intermediate the first and second sections and wherein said means for suitably locking includes a separate transverse bar longitudinally slidable along each of said second and third sections adjacent said ribbon, each said bar engaging thin grooves in the sides of its respective said elongated body section, and said grooves being at a slight angle to said body section, so that longitudinal movement of said bar along said body causes said bar to releasably lock said ribbon to said body section.

10. An improved tool according to claim 1 in which said thin localized region is a living hinge.

11. An improved tool according to claim 1 in which said rotatable member is adapted for snap-on engagement to said body.

12. An improved tool according to claim 1 further comprising a second thin localized transverse region intermediate said member and said pulley and spaced from said first thin localized transverse region so that said elongated body is disposed into three interconnected hinged sections.

13. A nut starting tool, comprising:

a longitudinally extended substantially flat body;

said body having near one end thereof a fixed peg projecting from said face of said body at a slight angle toward said one end and so shaped as to engage a thread of the nut, upon which peg hollow threaded workpiece nuts of various sizes may be rotatably mounted;

a pulley rotatably mounted to the body near the opposite end thereof, said pulley having its axis substantially perpendicular to said face and having a continuous groove about its exterior; and a continuous elastomeric member engageable with the groove of the pulley and engageable with the exterior of a workpiece nut mounted on the peg whereby a workpiece nut mounted on said peg is urged by said member against the semi-pointed end of said peg, said end engaging the groove of said workpiece nut thread.

14. The tool of claim 13 wherein the diameter of the peg is smaller than the internal diameter of the aperture of the smallest workpiece nut to be mounted to the peg.

15. The tool of claim 14 wherein the main body extends beyond the pulley to form a handle.

* * * * *

UNITED STATES PATENT AND TRADEMARK OFFICE

CERTIFICATE OF CORRECTION

PATENT NO. : 4,765,209

DATED : August 23, 1988

INVENTOR(S) : Buddy Klebold and Joe Howard

It is certified that error appears in the above-identified patent and that said Letters Patent is hereby corrected as shown below:

In Column 4, line 10, change 23 to -- 33 --.

Signed and Sealed this

Third Day of January, 1989

*Attest:*

DONALD J. QUIGG

*Attesting Officer*

*Commissioner of Patents and Trademarks*